US008644977B2

(12) United States Patent
Adachi et al.

(10) Patent No.: US 8,644,977 B2
(45) Date of Patent: Feb. 4, 2014

(54) SYSTEM FOR CONTROLLING POURING MACHINES, EQUIPMENT FOR POURING MOLTEN METAL AND METHOD OF POURING

(75) Inventors: Tsutomu Adachi, Nagoya (JP); Tadashi Nishida, Nagoya (JP)

(73) Assignee: Sintokogio, Ltd., Aichi (JP)

( * ) Notice: Subject to any disclaimer, the term of this patent is extended or adjusted under 35 U.S.C. 154(b) by 0 days.

(21) Appl. No.: 13/393,134

(22) PCT Filed: Jul. 16, 2010

(86) PCT No.: PCT/JP2010/062070

§ 371 (c)(1),
(2), (4) Date: May 9, 2012

(87) PCT Pub. No.: WO2011/030618

PCT Pub. Date: Mar. 17, 2011

(65) Prior Publication Data

US 2012/0232688 A1 Sep. 13, 2012

(30) Foreign Application Priority Data

Sep. 10, 2009 (JP) ..... 2009-209565
Jun. 14, 2010 (JP) ..... 2010-135386

(51) Int. Cl.
*G05B 15/02* (2006.01)

(52) U.S. Cl.
USPC ..... 700/146; 700/147; 164/80

(58) Field of Classification Search
USPC ..... 700/145, 146, 147; 164/4.1, 80, 130, 164/136
See application file for complete search history.

(56) References Cited

U.S. PATENT DOCUMENTS

| | | | | |
|---|---|---|---|---|
| 5,701,945 | A * | 12/1997 | McKibben et al. | 164/130 |
| 7,475,716 | B2 * | 1/2009 | Hunter et al. | 164/4.1 |
| 8,327,912 | B2 * | 12/2012 | Terada et al. | 164/136 |
| 2005/0109478 | A1 * | 5/2005 | Hunter et al. | 164/4.1 |
| 2008/0196856 | A1 * | 8/2008 | Terada et al. | 164/136 |

FOREIGN PATENT DOCUMENTS

| | | |
|---|---|---|
| JP | 58-038657 | 3/1983 |
| JP | 63-268562 | 11/1988 |
| JP | 02-089561 | 3/1990 |
| JP | 2009-202215 | 9/2009 |

OTHER PUBLICATIONS

International Search Report dated Sep. 28, 2010 issued in International Application No. PCT/JP2010/062070.

* cited by examiner

*Primary Examiner* — Charles Kasenge
(74) *Attorney, Agent, or Firm* — Finnegan, Henderson, Farabow, Garrett & Dunner, L.L.P.

(57) ABSTRACT

A system for controlling pouring machines, equipment for pouring molten metal using the system and a method of pouring the molten metal where the molten metal can be smoothly poured by the coordinated operation of a casting machine having a first automatic pouring machine and the second automatic pouring machine. The system for controlling the pouring machines has a main control device, a control device for controlling the first pouring machine, and a control device for controlling the second pouring machine so that the operations of two automatic pouring machines are controlled and a smooth coordinated operation of the two automatic pouring machines is realized so that the automatic pouring machines can pour the molten metal into each of a number of molds of a casting line for molds.

7 Claims, 6 Drawing Sheets

Fig. 5

| number of pattern | weight of molten metal poured | quality of molten metal | data at sprue | data on locus of pouring |
|---|---|---|---|---|
| 001 | 15 | 5 | 1 | 001 |
| 002 | 18 | 5 | 2 | 002 |
| 003 | 19 | 5 | 4 | 003 |
| 004 | 20 | 5 | 2 | 004 |
| - | - | - | - | - |
| - | - | - | - | - |
| - | - | - | - | - |
| 120 | 20 | 9 | 2 | 001 |
| 121 | 18 | 9 | 2 | 101 |
| 122 | 15 | 9 | 3 | 102 |
| 123 | 17 | 9 | 4 | 004 |
| 124 | 22 | 9 | 5 | 104 |
| - | - | - | - | - |
| - | - | - | - | - |
| - | - | - | - | - |
| 250 | 20 | 14 | 2 | 200 |
| 251 | 18 | 14 | 5 | 102 |
| 252 | 15 | 14 | 4 | 202 |
| 253 | 22 | 14 | 2 | 203 |
| 254 | 25 | 14 | 1 | 104 |

SYSTEM FOR CONTROLLING POURING MACHINES, EQUIPMENT FOR POURING MOLTEN METAL AND METHOD OF POURING

FIELD OF INVENTION

This invention relates to a control system for controlling a molten metal pouring machine (hereafter, also pouring machine) by coordinating the operation of two automatic pouring machines, equipment for pouring molten metal using the system and a method of pouring the molten metal by the coordinated operation of two pouring machines.

BACKGROUND

Conventionally if an automatic pouring machine pours the molten metal into molds of a high speed casting line for mold such as a casting line for mold, which line has a number of cavities for casting products formed by a number of flaskless molding molds lined up in a row in sets of pairs of molds placed cavity-side together, the automatic pouring machine must necessarily pour the molten metal at high speed (for example, within 4-7 seconds per one set of cavities of casting product cavities). So, very often two automatic pouring machines are used. These two automatic pouring machines used a method for pouring the molten metal at fixed points by fixed-point method.

However, for pouring by the fixed-point method the coordinated operation of the molding machine and the two automatic pouring machines is hard to realize. So, the molten metal is often supplied to the two automatic pouring machines only while the operation of the molding machine is stopped. Also, it sometimes happened that the molten metal was not poured into some molds.

Recently a study was made on a method of pouring the molten metal or equipment using a method where two pouring machines and a traverser were used to pour the molten metal into the molds of the casting line that transports the molds keeping the cavity surface flat (Patent document 1). However, for a casting line for mold that transports the molds at a higher speed such as one that has a number of cavities for casting products lined up in a row in sets of pairs of molds placed cavity-side together, in which the faces of the cavities are placed perpendicularly to the running direction of the molds, two automatic pouring machines that can pour the molten metal into the molds of the casting line for mold and whose operations are fully coordinated with the operation of the casting line for mold, thereby appropriately pouring the molten metal in all the molds and preventing the molds that fail to have the molten metal poured, are required.

RELATED DOCUMENTS

Patent Documents

Patent document 1: Publication of Japanese patent application, Publication No. 2009-202215

SUMMARY OF INVENTION

Problem to be Solved by Invention

The present invention provides a control system for controlling pouring machine where the molten metal can be smoothly poured by the the coordinated operation of a molding machine and two automatic pouring machines, where the automatic pouring machines pours the molten metal into each of a number of molds of a casting line for mold which molds are sent out in a row from the molding machine. The present invention also provides equipment for pouring the molten metal using the system and a method therefor.

Means to Solve Problem

The system for controlling pouring machines of the present invention controls the operations of two automatic pouring machines so that the operations of the first automatic pouring machine and the second automatic pouring machine are coordinated so as to have the molten metal be poured into each of a number of molds of a casting line for mold, which molds are sent out in a row from a molding machine, the first automatic pouring machine comprising a first carriage that can run in the direction of the molds of the casting line for mold, which molds are lined up in a row, and a first pouring ladle that is attached to and transported by the first carriage, and the second automatic pouring machine comprising a second carriage that can run in the direction of the molds of the casting line for mold, which molds are lined up in a row, and a second pouring ladle that is attached to and transported by the second carriage, wherein the system for controlling pouring machines comprises:

- a main control device attached to a ground control panel disposed on the ground;
- a control device for controlling the first pouring machine disposed on a control panel mounted on the first carriage; and
- a control device for controlling the second pouring machine disposed on a control panel mounted on the second carriage;

wherein the main control device comprises a device for storing the data on mold, which device stores the data on mold and the number of the mold for each mold, and the data on mold that are stored in the device for storing the data on a mold comprise at least the information for each mold on the pattern that was used for molding each mold and also the information for each mold as to whether the first pouring ladle is scheduled to pour the molten metal in a mold and whether the second pouring ladle completed pouring the molten metal into the mold;

wherein the control device for controlling the first pouring machine comprises:

- a first device for receiving the data on mold, which device receives the data on mold from the device for storing the data on mold of the main control device;
- a device for receiving information on the weight, which device receives information on the weight of the molten metal in the pouring ladle from a detecting device that detects the weight of the molten metal in the first pouring ladle;
- a device for indicating the number of the pouring machine, which device calculates the number of molds and identifies the molds into which the molten metal can be poured, where the molds are counted starting from the leading mold in the running direction of the molds into which the molten metal have not yet been poured and where the calculation is made based on the information on the weight of the molten metal in the pouring ladle and on the pattern of each mold, which information is received from the first device for receiving the data on mold and the device for receiving information on the weight, and where the device for indicating the number of the pouring machine instructs the device for storing the data on mold of the main control device to enter the data on the molds that are identified as ones into which the first pouring ladle is scheduled to pour the molten metal;

a device for determining the molds into which the first pouring machine pours the molten metal, which device determines the mold into which the molten metal is to be poured based on the data on mold that were received by the first device for receiving the data on mold and based on the information on the current positions of the mold;

a device for instructing the first pouring ladle to start pouring, which device gives the instructions to cause the movement of the first carriage and the start of pouring by the first pouring ladle to enable the first pouring ladle to pour the molten metal into the molds that are identified by the device for determining the molds into which the first pouring machine pours the molten metal;

wherein the control device for controlling the second pouring machine comprises:

a second device for receiving the data on mold, which device receives the data on mold from the device for storing the data on mold of the main control device;

a device for determining the molds into which the second pouring machine pours the molten metal, which device determines the mold which the molten metal is to be poured into based on the data on mold that were received by the second device for receiving the data on mold and based on the information on the current positions of the molds;

a device for instructing the second pouring ladle to start pouring, which device gives the instructions to cause the movement of the second carriage and the start of pouring by the second pouring ladle to enable the second pouring ladle to pour the molten metal into the molds that are identified by the device for determining the molds into which the second pouring machine pours the molten metal.

Also, the equipment for pouring the molten metal of the present invention comprises the first automatic pouring machine comprising the first carriage that can run in the direction of the molds of the casting line for mold, which molds are lined up in a row, and the first pouring ladle that is attached to and transported by the first carriage; the second automatic pouring machine comprising the second carriage that can run in the direction of the molds of the casting line for mold, which molds are lined up in a row, and the second pouring ladle that is attached to and transported by the second carriage; and the system for controlling pouring machines, which system controls the two automatic pouring machines so that the operations of the first automatic pouring machine and the second automatic pouring machine are coordinated so as to have the molten metal be poured into each of a number of molds of a casting line for mold, which molds are sent out in a row from the molding machine. The system for controlling pouring machines used for the equipment for pouring the molten metal is the one that was explained above.

A method of pouring the molten metal of the present invention is one wherein the operations of two automatic pouring machines are controlled so that the operations of the first automatic pouring machine and the second automatic pouring machine are coordinated so as to have the molten metal be poured into each of a number of molds of a casting line for mold, which molds are sent out in a row from the molding machine, the first automatic pouring machine comprising the first carriage that can run in the direction of the molds of the casting line for mold, which molds are lined up in a row and the first pouring ladle that is attached to and transported by the first carriage and the second automatic pouring machine comprising the second carriage that can run in the direction of the molds of the casting line for mold, which molds are lined up in a row and the second pouring ladle that is attached to and transported by the second carriage, wherein for the first automatic pouring machine the control device for controlling the first pouring machine controls the pouring of the first pouring ladle and for the second automatic pouring machine the control device for controlling the second pouring machine controls the pouring of the second pouring ladle.

Effect of Invention

By controlling the operations of the two automatic pouring machines the present invention realized the coordinated operation of two automatic pouring machines so that they can pour the molten metal appropriately into each of a number of molds of the casting line for mold, which molds are sent out in a row from the molding machine.

BRIEF DESCRIPTION OF INVENTION

Figure 4:
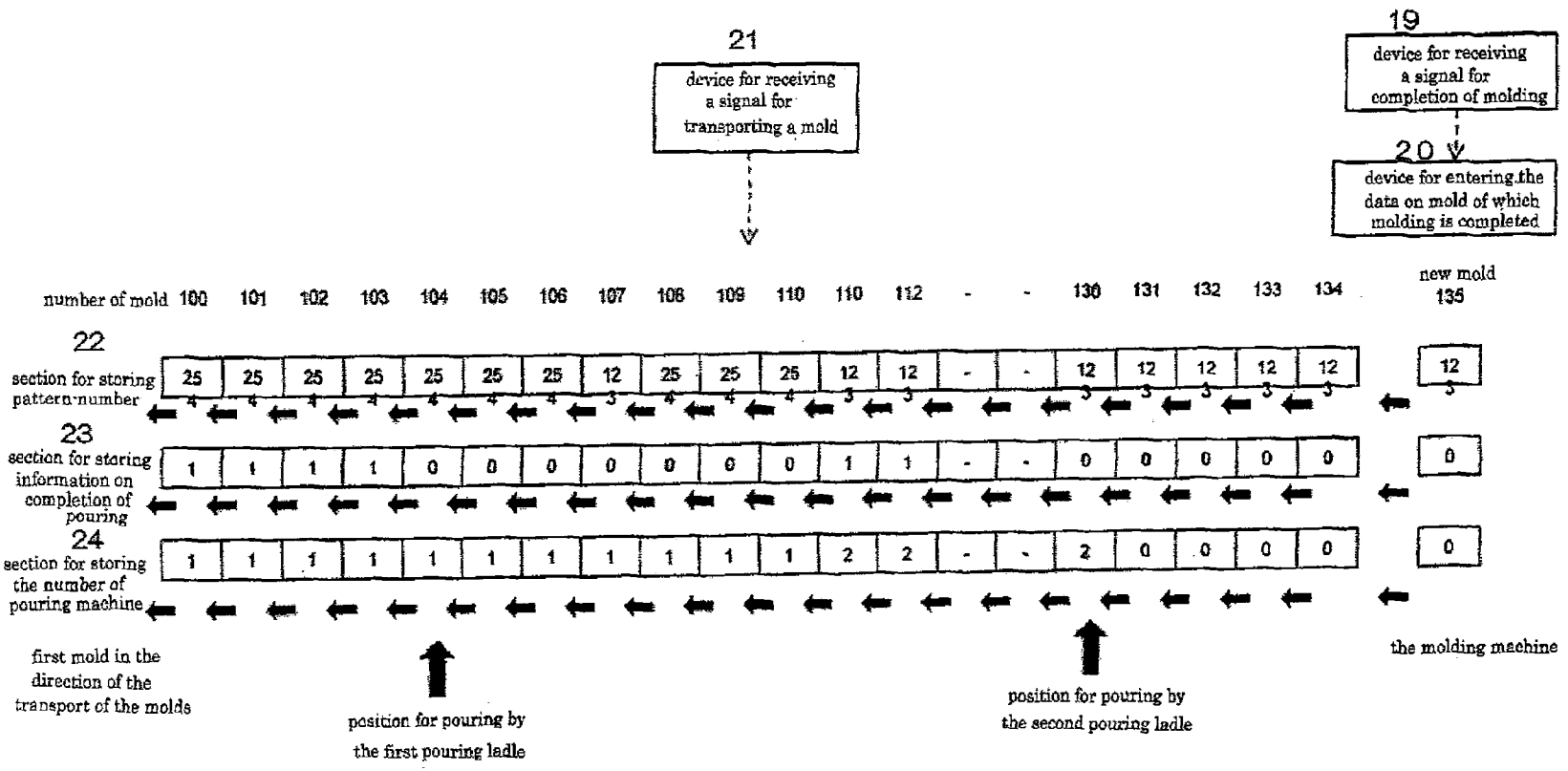

FIG. 4 gives a schematic view of the various data on molds that are stored in the ground control panel, showing a plan view of the groups of molds and the two automatic pouring machines in normal operation, pouring the molten metal into the group of molds.

FIG. 5 shows the data on molds that are stored in the controllers of the control panels of the first and second carriages.

Figure 6:
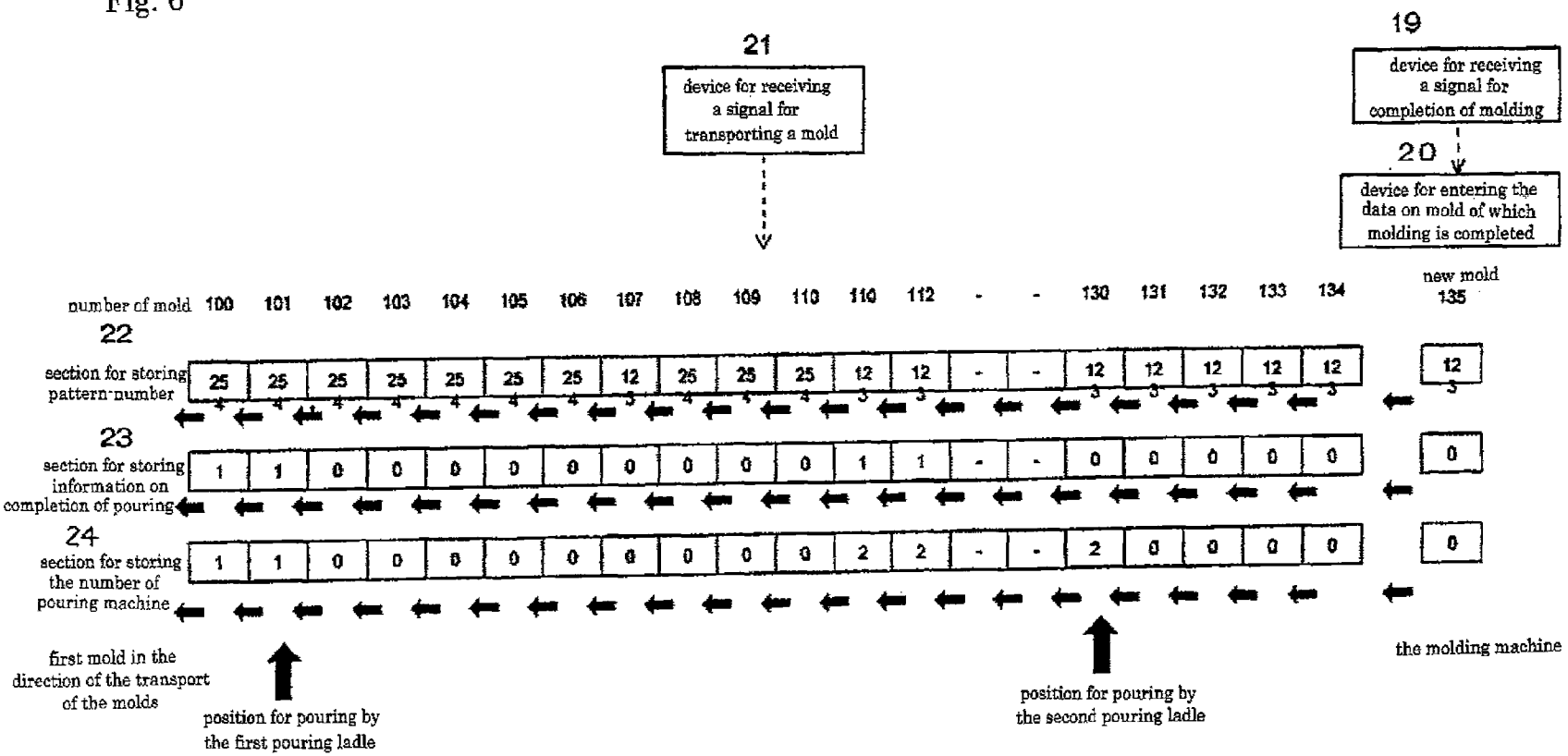

FIG. 6 gives a schematic view of the various data that are stored in the ground control panel, showing a plane view of the group of molds after the molten metal is supplied to the first pouring ladle of the first carriage and the initial positions of the two automatic pouring machines.

EMBODIMENT OF CARRYING OUT INVENTION

Figure 1:
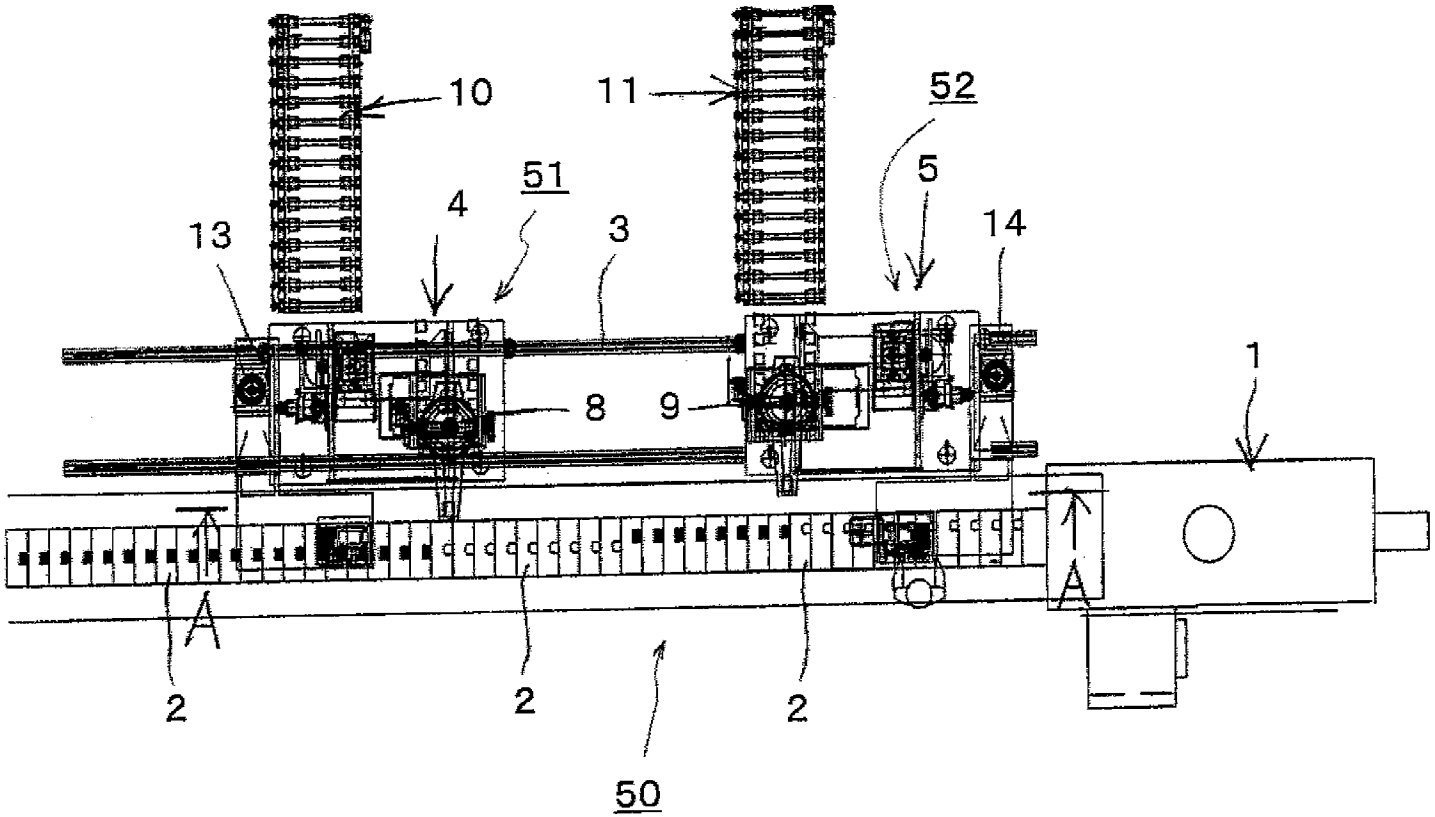
FIG. 1 is a plane view of a casting line for mold, to which the present invention is applied.

An example of the casting line for mold of the present invention is explained by referring to FIGS. 1-6. As shown in FIG. 1, in the casting line for mold many flaskless vertical molds 2 that were molded by a high speed molding machine are lined up and extended to the left direction while the mold forms a cavity for product by the cavity-surfaces being joined.

Rails 3 are laid parallel to the group of the molds, and the two carriages for the pouring ladles (hereafter, also called "the first carriage 4" and "the second carriage 5") that can run along the group of molds are installed as transporting devices.

The first carriage 4 and the second carriage 5 are provided with driving devices 6, 7, respectively (see FIG. 2), and both are self-propelled. Further, the first pouring ladle 8 and the second pouring ladle 9 that each can pour the molten metal into the cavity for product of the mold 2 by being tilted are disposed on the first carriage and the second carriage, respectively.

Also, the first pouring ladle 8 and the second pouring ladle 9 can be transported onto and out of the first carriage 4 and the second carriage 5, respectively, by the respective first and the second roller conveyors 10, 11, that are installed perpendicularly to the rails 3. The first and the second roller conveyors 10, 11, each have rotatable rollers.

The first pouring ladle 8 of the first carriage 4 plays a main role in pouring the molten metal while the second pouring ladle 9 of the second carriage 5 plays a supplementary role in pouring.

Also, the first carriage 4 and the first pouring ladle 8 constitute the first automatic pouring machine 51 and the second carriage 5 and the second pouring ladle 9 constitute the second automatic pouring machine 52. Further, the first automatic pouring machine 51 and the second automatic pouring machine 52 work by their coordinated operation in cooperation with the system for controlling pouring machines 53 that is explained below, as equipment for pouring the molten metal 50 that pours the molten metal into a number of molds that are sent out in a row from the molding machine.

Figure 2:
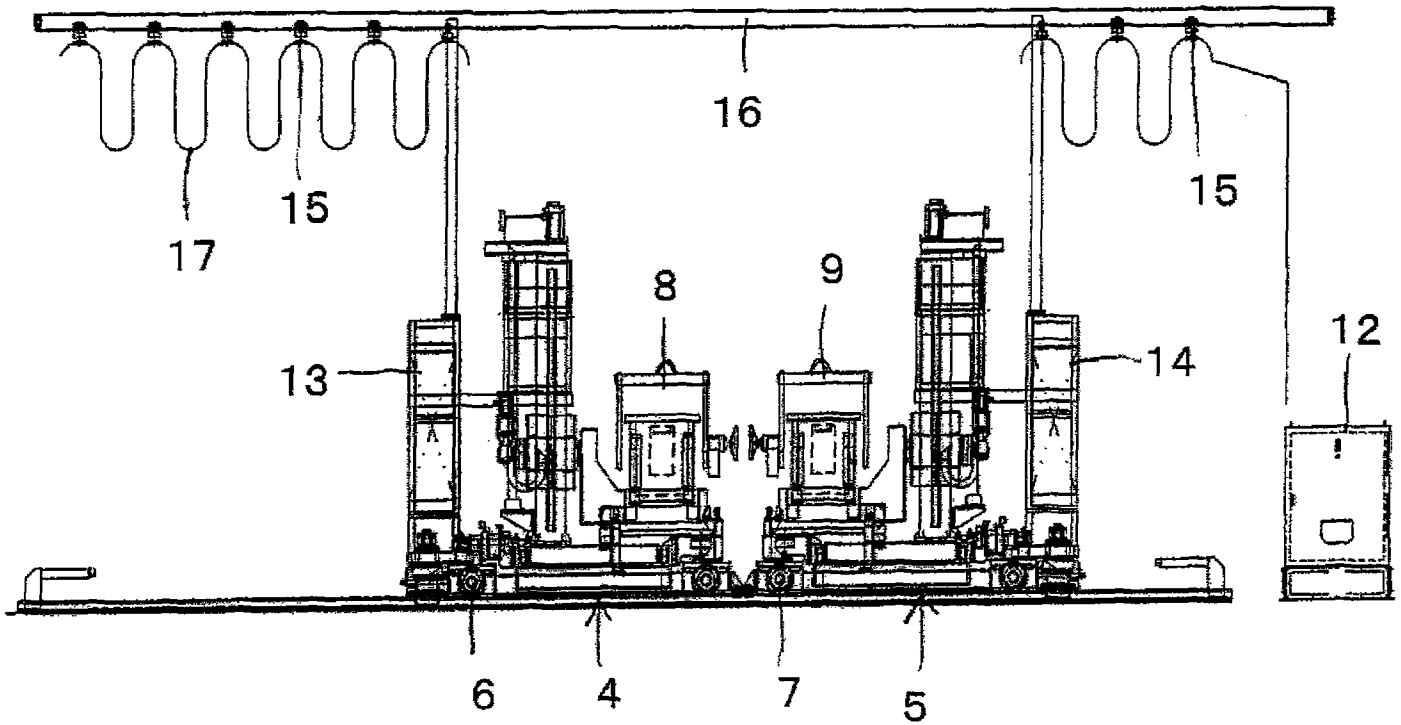
FIG. 2 is a perspective view of the casting line for mold of FIG. 1 as seen from the direction of A-A.

Also, for the casting line for mold of the present invention as shown in FIG. 2, as a control panel that controls the operations of the molding machine 1, the movement of the first carriage 4 and the second carriage 5, a ground control panel 12 installed on the ground, and the control panel 13 of the first carriage 4, and the control panel 14 that are installed on the first carriage 4 and the control panel 14 of the second carriage 5, respectively, are provided. The ground control panel 12 is electrically connected to the control panel 13 of the first carriage 4 and to the control panel 14 of the second carriage 5 by cable 17 that is supported by a number of pulleys 15 attached to the rails 16.

The main control device 12*a* attached to the ground control panel 12, the control device for controlling the first pouring machine 13*a* that is disposed on the first carriage 4, and the control device for controlling the second pouring machine 14*a* that is disposed on the second carriage 5, constitute a system for controlling pouring machines 53 that coordinates the operations of the first automatic pouring machine and the second automatic pouring machine.

The equipment for pouring the molten metal 50 of the present invention comprises two automatic pouring machines, i.e., the first and second automatic pouring machines, and a system for controlling pouring machines, wherein the first automatic pouring machine 51 comprises:

the first carriage 4 that runs along a number of molds 2 lined up in a row that are sent out from the molding machine 1 and the first pouring ladle 8 that is attached to and transported by the first carriage 4, and the second automatic pouring machine 52 comprises:

the second carriage 5 that runs along a number of molds 2 lined up in a row, and the second pouring ladle 9 that is attached to and transported by the second carriage 5, and wherein the system for controlling pouring machines 53 controls the operations of two automatic pouring machines so that the operations of the first automatic pouring machine and the second automatic pouring machine are coordinated so as to have the molten metal be poured into each of a number of molds 2 that are sent out in a row from the molding machine.

Figure 3:
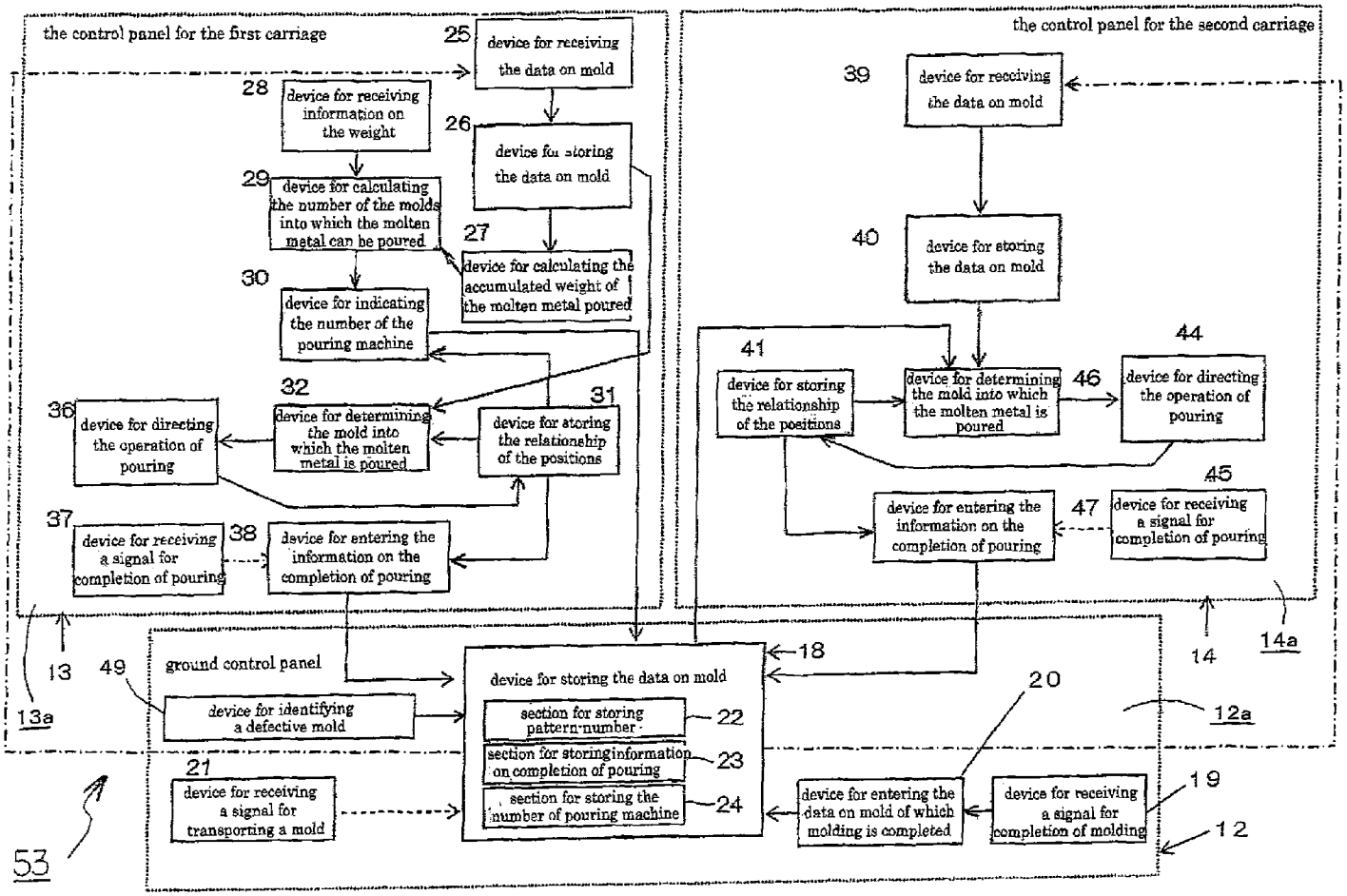
FIG. 3 shows a block diagram of the control panel comprising the system for controlling pouring machines of the present invention.

Next the constitution of the system for controlling pouring machines 53 is explained in detail by referring to FIG. 3. The main control device 12*a* that is disposed in the ground control panel 12 comprises:

a device for storing the data on mold 18 that stores data on mold and the number of the mold a device for receiving a signal for completion of molding 19, which device receives a signal for completion of molding by the molding machine 1 a device for entering the data on mold, of which the molding is completed 20, the date being entered into the device for storing the data on mold 18 based on the signal from the device for receiving a signal for completion of molding 19, and a device for receiving a signal for transporting a mold 21, which device receives a signal from the molding line 1 that the mold has been transported.

The data that are stored in the device for storing the data on mold 18 comprises at least information for each mold on the pattern that was used for molding and the information for each mold on whether the first pouring ladle 8 is scheduled to pour the molten metal into the mold, and whether the second pouring ladle 9 has completed the pouring.

More specifically, the device for storing the data on mold 18 comprises a section for storing pattern-number 22, which section stores the data for the patterns that were used for molding molds 2, a section for storing information on completion of pouring 23, which section stores the data as to whether the pouring is completed for each mold, and a section for storing the number of pouring machine 24, which section stores either one of the reference numbers for the first pouring ladle 8 or the second pouring ladle 9.

The section for storing pattern-number 22, the section for storing information on completion of pouring 23, and the section for storing the number of pouring machine 24 each store the data and the number of the mold that corresponds to the data. Also, the section for storing pattern-number 22 stores the type of pattern that is used for molding mold by the number that is allocated to each type of pattern. The section for storing information on completion of pouring 23 stores the information on whether the pouring is complete or not by giving either number "0" or "1." The number "0" denotes "the pouring is not completed" and the number "1" denotes "the pouring is completed." The section for storing the number of pouring machine 24 stores the information as to whether the first pouring ladle 8 is scheduled to pour or the first pouring ladle 8 has completed the pouring. Also, it stores the information as to whether the second pouring ladle 9 has completed the pouring or the second pouring ladle is in another state. Each of these states is referred to by the numbers "0", "1," or "2" and stored in the section for storing the number of pouring machine 24. That is, "1" denotes that the first pouring ladle 8 of the first pouring machine is scheduled to pour the molten metal or has completed the pouring, "2" denotes that the second pouring ladle 9 of the second pouring machine has completed the pouring, and "0" denotes that it is not yet determined which of the first of the second pouring machine is scheduled to pour the molten metal or has completed the pouring. The number "1" includes both states where the first pouring ladle 8 is scheduled to pour the molten metal or the first pouring ladle 8 has completed the pouring. But by referring to the data stored in the section for storing information on completion of pouring 23, it can be determined in which state the first pouring ladle 8 is, i.e., "scheduled to pour the molten metal" or "completed the pouring."

Also, the ground control panel 12 comprises a display that can show the data on molds that are stored in the device for storing the data on mold 18. For example, as is shown in FIG. 4, the display shows items that include "the numbers of the mold" that are the sequential numbers (numbers in order) given to the molds of the casting line for mold, "the numbers of the patterns" that are given depending on the type of pattern that is used for molding molds for the casting line for mold, "the information on completion of pouring" as to whether the pouring of each mold of the casting line for mold has been completed or has not yet been completed, and the "number of the pouring machine" (machine no.) for each of the first carriage 4 and the second carriage 5.

The control device for controlling the first pouring machine 13*a* of the control panel of the first carriage 13 controls each component of the first automatic pouring machine 51. More specifically, as shown in FIG. 3, the control device for controlling the first pouring machine 13*a* comprises a device for receiving the data on mold 25 a device for storing the data on mold 26, a device for calculating the accumulated weight of the molten metal poured 27, a device for receiving information on the weight 28, a device for calculating the number of the molds into which that the molten metal can be poured 29, a device for indicating the number of the pouring machine 30, a device for storing the relationship of the positions 31, a device for determining the mold into which the molten metal is poured 32, a device for directing the operation of pouring 36, a device for receiving a signal for completion of pouring 37, and a device for entering the information on the completion of pouring 38.

The device for receiving the data on mold 25 receives from the device for storing the data on mold 18 of the main control device 12*a* the data on mold that include the number of the pattern corresponding to the number of the mold, the information on completion of pouring, and the number of the pouring machine. The device for storing the data on mold 26 works as data table for the control device for controlling the first pouring machine 13*a* and stores the data on mold that the device for receiving the data on mold 25 received. Also, the device for storing the data on mold 26 stores the data corresponding to the number of the pattern, such as the required "weight of the molten metal poured," "quality of the molten metal," and "data at the sprue" and the "data on the locus of the pouring" that show the speed of the tilting and the angle of tilting of the pouring ladle when the molten metal is poured.

The device for calculating the accumulated weight of the molten metal poured 27 calculates the accumulated weight of the molten metal that is scheduled to be poured based on the information that is stored in the device for storing the data on mold 26. Namely, the device for calculating the accumulated weight of the molten metal poured 27 calculates the accumulated weight of the molten metal that is scheduled to be poured into the molds where the pouring of the molten metal has not been completed, in the order of the number of the molds, based on "the number of the molds," "the number of the patterns," "the information on completion of pouring," etc. The weight of the molten metal for each mold is stored, for example, in the device for storing the data on mold 26, where the number is referred to by number of its pattern. The device for calculating the accumulated weight of the molten metal poured 27 can identify the molds where the molten metal is poured continuously by the first pouring ladle 8 into such molds without having the pouring ladle replaced by another ladle, as explained below.

The device for receiving information on the weight 28 receives the information on the weight of the molten metal in the pouring ladle 8 from a device for detecting the weight of the molten metal (not shown) that detects the weight of the molten metal in the first pouring ladle 8. This device for detecting the weight of the molten metal is, for example, a load cell. The device for receiving information on the weight 28 receives the information on the weight of the molten metal in the pouring ladle 8 that was detected by the load cell.

The device for calculating the number of the molds into which the molten metal can be poured 29 calculates the numbers of molds and identifies the molds into which the molten metal can be poured, where the molds into which the molten metal have not yet been poured are counted starting from the leading mold in the running direction of the molds, and where the count is made based on the information on the weight of the molten metal in the pouring ladle and the information on the pattern of each mold that are received from the device for receiving the data on mold 25 and the device for receiving information on the weight 28. That is, based on the information on the weight of the molten metal in the pouring ladle from the device for receiving information on the weight 28 and the information on the accumulated weight of the molten metal that is scheduled to be poured from the device for calculating the accumulated weight of the molten metal poured 27, the device for calculating the number of the molds into which the molten metal can be poured 29 calculates the number of molds into which the first pouring ladle 8 can pour the molten metal. More specifically, as the weight of the molten metal that is poured into the mold varies depending on the molds, the device for calculating the number of the molds into which the molten metal can be poured 29 can identify the last mold into which the first pouring ladle 8 can pour the molten metal without being replaced by the other ladle where the molten metal is poured into the molds in the order that starts from the leading mold of the molds that is yet to be filled.

In other words, the device for calculating the number of the molds into which the molten metal can be poured 29 determines the last mold, into which the molten metal can be poured by comparing the weight of the molten metal in the ladle with the accumulated weight of the molten metal that is to be poured into the molds and identifying the mold, which is the last mold but one, where the accumulated weight of the molten metal to the last mold first exceeds the weight of the molten metal in the ladle.

The device for indicating the number of the pouring machine 30 instructs the device for storing the data on mold 18 of the main control device 12*a* to enter the data, assuming that the pouring is carried out by the first pouring ladle 8 into the molds, the numbers of which molds are calculated by the device for calculating the number of the molds that the molten metal can be poured 29. More particularly, for information on "the number of pouring machine" that is stored in the section for storing the number of pouring machine 24, a "1" is each entered into the data for each mold that is scheduled to be filled with the molten metal.

The device for calculating the accumulated weight of the molten metal poured 27, the device for calculating the number of the molds into which the molten metal can be poured 29, and the device for indicating the number of the pouring machine 30 are explained to have each function that is stated above. But a composite device that has all these functions in one body can be used.

That is, for example, the device for indicating the number of the pouring machine 30 calculates the numbers of molds and identifies the molds into which the molten metal can be poured, where the molds into which the molten metal have not yet been poured, are counted starting from the leading mold in the running direction of the molds, and where the counting is made based on the information on the weight of the molten metal in the pouring ladle and the information on the pattern of each mold that are received from the device for receiving the data on mold 25 and device for receiving information on the weight 28. Then the data can be entered into the device for storing the data on mold 18 of the main control device, assuming that the numbers of the molds thus calculated are the molds into which the first pouring ladle is scheduled to pour the molten metal.

The system for controlling pouring machines 53 of the present invention has a push button, etc, attached to the ground control panel 12 as a device for identifying a defective mold 49. If an operator finds, for example, visually, any defective mold, by using the device for identifying a defective mold 49 he or she operates the pouring ladle so that it does not pour the molten metal into such mold. If the device for identifying a defective mold 49 is operated, the information on the number of the pouring machine" in the section for storing the number of pouring machine 24 is changed from "0" or "1" to "x." The device for identifying a defective mold 49 can be disposed at the control panel of the first carriage 13 or the control panel of the second carriage 14 in place of the ground control panel 12. The devices for identifying a defective mold 49 can be placed at plurality of positions. The device for calculating the accumulated weight of the molten metal poured 27, the device for indicating the number of the pouring machine 30, etc., can detect from the device for receiving the data on mold 25, etc., that the information in the section for storing the number of pouring machine 24 has been changed by the devices for identifying a defective mold 49. Then they determine if the number of the pouring machine for the mold that comes after the mold for which the number of the pouring machine has been changed to "x" is changed. If the number of the pouring machine for the mold that comes after the mold is changed, the device for indicating the number of the pouring machine 30 instructs the device for storing the data on mold 18 of the main control device 12*a* to enter such a change. Thus the device for indicating the number of the pouring machine 30, etc., also function as a device for changing the number of the pouring machine.

The device for storing the relationship of the positions 31 stores the position of the first carriage 4. The device for determining the mold into which the molten metal is poured 32, based on the information from the device for storing the data on mold 26 and based on the information from the device for storing the relationship of the positions 31, determines the mold which the molten metal is poured into, and into which the pouring is made based on the data on mold received by the device for receiving the data on mold 25 and based on the information on the current position of the first carriage 4. More specifically, the device for determining the mold into which the molten metal is poured 32 determines to pour the molten metal by the first pouring ladle 8 into the leading mold (the mold that has the smallest number of the mold) in the direction of the transport of the molds, which molds are scheduled to be poured by the first pouring ladle 8. That is, they are the molds for which the section for storing the number of pouring machine 24 registers with a "1" and into which the molten metal is not yet poured into, that is, the molds that the section for storing information on completion of pouring 23 registers with a "0."

The device for determining the mold into which the molten metal is poured 32 determines to pour the molten metal into the leading mold (the mold that has the smallest number of the molds) in the direction of the transport of the molds by the first pouring ladle 8, when the molds that are registered as having "1" by the section for storing the number of pouring machine 24 are transported into the predetermined area. The wording "the predetermined area" can include, for example, the area where the first pouring ladle 8 can move driven by the first carriage 4 or within the area that is separated by more than a predetermined distance from the position of the second pouring ladle 9, which position is determined by the information on the position of the second carriage 5. In this embodiment, it was designed that the first pouring ladle 8 pours the molten metal into the molds that are registered as having "1" when the molds are transported into "the predetermined area." But by providing the base position for the first pouring ladle 8 the first pouring ladle 8 can also be made to pour the molten metal into the leading mold (the mold that has the smallest number of the molds) in the direction of the transport of the molds when the mold that is registered as having "1" by the section for storing the number of pouring machine 24 is transported before the base position for the first pouring ladle 8 (the corresponding position).

The device for directing the operation of pouring 36 instructs the first carriage 4 to move and the first pouring ladle 8 to start the pouring into the molds that were determined by the device for determining the mold into which the molten metal is poured 32. More specifically, the device for directing the operation of pouring 36 has the function of instructing the first carriage 4 to move based on the information on the current position that is stored in the device for storing the relationship of the positions 31 and based on the information on transporting a mold received by the device for receiving the data on mold 25. Also, the device for directing the operation of pouring 36 has the function of instructing the pouring ladle to pour the molten metal into the molds corresponding to the types of patterns used for molding molds based on "the data on the locus of the pouring," etc., that are stored in the device for storing the data on mold 26.

If the device for receiving a signal for completion of pouring 37 receives a signal that the pouring is completed from a device for detecting the completion of pouring such as a sensor, the device for receiving a signal for completion of pouring 37 sends the information to the device for entering the information on the completion of pouring 38. The device for entering the information on the completion of pouring 38 that has received the information from the device for receiving a signal for completion of pouring 37 instructs the device for storing the data on mold 18 of the main control device 12*a* to enter the data. The device for storing the data on mold 18 that has received the instructions to enter the data changes "0" to "1" in "the information on the completion of pouring" stored in the section for storing information on completion of pouring 23.

Also, the control device for controlling the second pouring machine 14*a* that is disposed on the control panel for the second carriage 14 controls various components of the second automatic pouring machine 52. More particularly, as shown in FIG. 3, the control device for controlling the second pouring machine 14*a* comprises a device for receiving the data on mold 39, a device for storing the data on mold 40, a device for storing the relationship of the positions 41, a device for determining the mold into which the molten metal is poured 46, a device for directing the operation of pouring 44, a device for receiving a signal for completion of pouring 45, and device for entering the information on the completion of pouring 47.

The device for receiving the data on mold 39 receives the data on mold such as the numbers of the patterns which correspond to the numbers of the molds from the device for storing the data on mold 18 of the main control device 12*a*, the information on the completion of pouring, the numbers of the pouring machines, etc. The device for storing the data on mold 40 works as the data table for the control device for controlling the second pouring machine 14*a* and stores the data on mold that the device for receiving the data on mold 39 has received. Also, the device for storing the data on mold 40 stores the necessary, the data corresponding to the numbers of the patterns that were used for molding, such as "weight of the molten metal poured," "quality of the molten metal," and "data at the sprue" and the "data on the locus of the pouring" that show the speed of tilting and the angle of tilting of the pouring ladle when the molten metal is poured.

The device for storing the relationship of the positions 41 stores the position of the second carriage 5. The device for determining the mold into which the molten metal is poured 46, based on the information from the device for storing the data on mold 39 and based on the information from the device for storing the relationship of the positions 41, determines the mold into which the molten metal is poured, of which the pouring is made based on the data on mold received by the device for receiving the data on mold 39 and based on the information on the current position of the second carriage 5. More specifically, the device for determining the mold into which the molten metal is poured 46, determines to pour the molten metal into the molds within "the predetermined area," which molds are other than those, into which the first pouring ladle 8 is scheduled to pour the molten metal.

That is, the device for determining the mold into which the molten metal is poured 46 determines to pour the molten metal into the leading mold (the mold that has the smallest number of the molds) in the direction of the transport of the molds by the second pouring ladle 9, when the molds that are registered as having "0" by the section for storing the number of pouring machine 24 are transported into the predetermined area. The wording "the predetermined area" can include, for example, the area where the second pouring ladle 9 can move driven by the second carriage 5 or within the area that is separated by more than a predetermined distance from the position of the first pouring ladle 8, which position is determined by the information on the position of the first carriage 4. In this embodiment, it was designed that the second pouring ladle 9 pours the molten metal into the molds that are registered as having "0" when the molds are transported into "the predetermined area." But by providing the base position for the second pouring ladle 9 the second pouring ladle 9 can also be made to pour the molten metal into the leading mold (the mold that has the smallest number of the molds) in the direction of the transport of the molds when the mold that is registered as having "0" by the section for storing the number of pouring machine 24 is transported before the base position for the second pouring ladle 9 (the corresponding position).

The device for directing the operation of pouring 44 instructs the second carriage 5 to move and the second pouring ladle 9 to start the pouring into the molds that are determined by the device for determining the mold into which the molten metal is poured 46. More specifically, the device for directing the operation of pouring 44 has the function of instructing the second carriage 5 to move based on the information on the current position that is stored in the device for storing the relationship of the positions 41 and based on the information on transporting a mold received by the device for receiving the data on mold 39. Also, the device for directing the operation of pouring 44 has the function of instructing the pouring ladle to pour the molten metal into the molds corresponding to the types of patterns used for molding the molds based on "the data on the locus of the pouring," etc., that are stored in the device for storing the data on mold 40.

If the device for receiving a signal for completion of pouring 45 receives a signal that the pouring is completed, from a device for detecting the completion of pouring such as a sensor, the device for receiving a signal for completion of pouring 45 sends the information to the device for entering the information on the completion of pouring 47. The device for entering the information on the completion of pouring 47 that has received the information from the device for receiving a signal for completion of pouring 45 instructs the device for storing the data on mold 18 of the main control device 12*a* to enter the data. The device for storing the data on mold 18 that has received the instructions to enter the data changes "0" to "1" in "the information on the completion of pouring" stored in the section for storing information on completion of pouring 23 and changes "the number of the pouring machine" from "0" to "2" in the section for storing the number of pouring machine 24.

Also, the control panel of the first carriage 13 and the control panel of the second carriage 14 each have a display that can show the data on molds that are stored in the devices for storing the data on mold 26, 40, respectively. For example, as is shown in FIG. 5, the display shows items that include "the numbers of the patterns" that are given depending on the type of patterns that are used for molding molds for the casting line for mold, the "weight of the molten metal poured," which is the weight of the molten metal poured into the mold using the pattern, and the "quality of the molten metal" that is poured into the mold using the pattern and that is stored by the number, the "data at the sprue," which data specify the position of the sprue of the mold by the number, and "the data on the locus of the pouring," which records the data on the locus of the pouring for each pouring ladle. The data on the locus of the pouring refer to the data on the locus of the pouring for each pouring ladle when it carries out the automatic pouring.

The equipment for pouring the molten metal 50, as in its initial state, has the first automatic pouring machine 51 and the second automatic pouring machine 52 at fixed positions, while neither the first pouring ladle 8 nor the second pouring ladle is installed in the respective pouring machines. Then the first pouring ladle 8 that has received the molten metal is transported into the first automatic pouring machine 51 by a first roller conveyor 10. After the first pouring ladle 8 is installed in the first automatic pouring machine 51, the molten metal is measured by a device for measuring the weight of the molten metal (not shown) (for example, a load cell) and the device for receiving information on the weight 28 receives the information on the weight of the molten metal in the first pouring ladle 8. Likewise the second pouring ladle 9 is transported into the second automatic pouring machine 52 by a second roller conveyor 11 and the second pouring ladle 9 is installed in the second automatic pouring machine 51.

For replacing the pouring ladle in the equipment for pouring the molten metal 50, it can be arranged that a signal instructing that the preparations for replacing the ladle by a new ladle is sent to a melting furnace, etc., when the amount of the molten metal in the ladle becomes, for example, less than the amount that can fill several molds (five molds). For the purpose of detecting the molten metal that still remains in the ladle, also the second automatic pouring machine 52 may comprise a detecting device such as a load cell, etc., and a device for receiving information on the weight, which device receives the weight that is detected by the detecting device.

Below one example of a method of pouring the molten metal, which method uses the equipment for pouring the molten metal 50 thus constituted is explained.

As is seen from FIG. 4, about the current position of the first carriage 4, first of all, a search for "1" is carried out in the numbers "1" of the pouring machine in the section for storing the number of pouring machine 24 of the device for storing the data on mold 18 of the ground control panel 12, starting from the downstream end of the line of the molds, which end is opposite to the end of the line of the casting line where the molding machine 1 is installed. Then the position (A) in the section for storing the number of pouring machine 24, which position (A) corresponds to the position (B) in the section for storing information on completion of pouring 23, which position (B) having the first "0," which means that the pouring is not completed, is the position of the mold into which the molten metal is next to be poured.

The number of the mold, etc., of this mold is entered into and stored in the device for storing the relationship of the positions 31 of the control panel for the first carriage 13. Next, the number of the pattern corresponding to the position for pouring of the first carriage 4 is retrieved by the device for receiving the data on mold 25. Then the control panel for the first carriage 13 retrieves the information on the mold into which the molten metal is poured and which mold was determined by the device for determining the mold into which the molten metal is poured 32.

More specifically, as shown in FIG. 5, the information includes the weight of the molten metal to be poured, the quality of the molten metal, the data at the sprue, and the data on the locus of the pouring, corresponding to the number of the pattern stored in the device for storing the data on mold 26. The device for determining the mold into which the molten metal is poured 32 sends a signal to the device for directing the operation of pouring 36 when the mold into which the molten metal is poured is transported into the predetermined area, that is, when the mold is moved to the position that corresponds to, for example, the base position, etc., of the first carriage 4.

After the first carriage 4 is moved to the position for pouring by the instructions of the device for directing the operation of pouring 36, the first pouring ladle 8 starts the pouring. The position in the device for storing the relationship of the positions 31 is renewed after the first carriage 4 is moved to the position for pouring. In the control panel for the first carriage 13 when the pouring is complete, the information to the effect is received by the device for receiving a signal for completion of pouring 37. Based on the information, the device for entering the information on the completion of pouring 38 has the symbol "1," which denotes the completion of pouring, entered into the position in the section for storing information on completion of pouring 23.

If the first pouring ladle 8 of the first carriage 4 becomes empty and the supply of the molten metal is complete, then a search is carried out in the section for storing pattern-number 22 of the device for storing the data on mold 18. More specifically, as seen from FIG. 6, the number of the molds into which the molten metal can be poured is calculated by the device for calculating the number of the molds into which the molten metal can be poured 29 via the device for calculating the accumulated weight of the molten metal poured 27, wherein the positions of the molds having a number of the mold of "0" in the section for storing the number of pouring machine 24, which number "0" denotes that the pouring machine is not determined, are searched in the opposite direction of the number of the molds, while the numbers of the patterns corresponding to the molds are stored through the device for receiving the data on mold 25, and the weight of the molten metal to be poured for each number of the pattern is retrieved from the device for storing the data on mold 26. Then the number "1" is booked in the section for storing pattern-number 22 of the device for storing the data on mold 18 through the device for indicating the number of the pouring machine 30. About the role of the device for indicating the number of the pouring machine 30 in the operation of the pouring equipment, normally the device for indicating the number of the pouring machine 30 is used during the pouring of the molten metal. But it can be used only when the supply of the molten metal is complete or only when the device for identifying a defective mold 49 is operated, as is described above.

On the other hand, as shown in FIG. 4, in the second carriage 5 a search is carried out in the section for storing pattern-number 22 in the downward direction, that is, in the direction from the second carriage 5 toward the first carriage 4 and stops before "1" in the first carriage 4, which "1" denotes the number of the first pouring machine. Then "0," which shows that the pouring is not completed, is detected after a search is made in the section for storing information on completion of pouring 23.

Next, as in the first carriage 4, the number of the pattern of the molds at the position for pouring where the second carriage 5 is to pour the molten metal is retrieved by the device for receiving the data on mold 39. Then the device for determining the mold which the molten metal is poured into 46 retrieves the data from the device for storing the data on mold 40. More specifically, the device for determining the mold which the molten metal is poured into 46 retrieves the weight of the molten metal to be poured, the quality of the molten metal, the data at the sprue, and the data on the locus of the pouring from the various data on mold as are shown in FIG. 5. Then after the second carriage 5 is moved to the position for pouring by the instructions of the device for directing the operation of pouring 44, the second pouring ladle 9 starts pouring.

After the second carriage 5 is moved, the control panel for the second carriage 14 changes the data on the position in the device for storing the relationship of the positions 41. When the pouring is completed, the device for receiving a signal for completion of pouring 45 instructs the device for entering the information on the completion of pouring 47 to enter "1," which denotes "the completion of the pouring" of the mold at the position for pouring, into the section for storing information on completion of pouring 23.

Also, the data on the quality of the molten metal are cross-checked to see if they match the data of the reference number for the first pouring ladle 8, which data were stored in advance. Then, the first pouring ladle 8 starts pouring after the section for storing information on completion of pouring 23 of the device for storing the data on mold 18 confirms that the data in the number of the mold is given as "0," which shows that the pouring is not completed. Thus the first pouring ladle 8 pours the molten metal into the mold 2 that is at the position for pouring based on the data on the locus of the pouring and stops pouring when the pouring reached the scheduled quantity. Then "1" is entered into the section for storing information on completion of pouring 23 to show that the pouring is completed.

When the molding machine 1 is ready to move the current mold, i.e., the mold 2, for which the pouring of the molten metal has been completed, and if, in the ground control panel 12, a signal is sent from a device for sending a signal for completion of molding 19 to the device for receiving a signal for completion of molding 20, the mold 2 is transported by a distance of one mold. Then the number of the pattern corresponding to the first mold 2, is stored as the information on the first mold of molds 2 in the section for storing pattern-number 22 and "0" is entered into the section for storing information on completion of pouring 23 and the section for storing the number of pouring machine 24.

In the meantime, if the preparations for pouring from the second pouring ladle 9 of the second carriage 5 are completed, a signal of the completion of the preparations for pouring is received by the device for directing the operation of pouring 44 of the control panel for the second carriage 14.

Then the second pouring ladle 9 is moved by the second carriage 5 to the mold 2, into which the molten metal has not yet been poured and into which mold the first pouring ladle 8 can pour the molten metal.

Then the numbers, including the reference number for the mold 2, which is at the position for pouring of the second carriage 5 is issued, and the device for storing the data on mold 18 instructs the section for storing pattern-number 22 to send the number of the pattern for the mold 2 which is at the position for pouring to the device for receiving the data on mold 39, which number is then sent to and stored in the device for storing the data on mold 40 of the second carriage 5.

Next, the weight of the molten metal to be poured, the quality of the molten metal, the data at the sprue, and the data on the locus of the pouring, corresponding to the number of the pattern at the position for pouring are obtained from the device for storing the data on mold 40 via the device for determining the mold into which the molten metal is poured 46 of the second carriage 5. The molten metal is poured, as in the first pouring ladle 8, into the mold 2 according to the data on the locus of the pouring. When the amount of the molten metal in the molds reaches the amount that is scheduled to be poured, the ladle is tilted back and the pouring stops. "1," which denotes the completion of pouring is entered into the section for storing information on completion of pouring 23.

Thus the method of pouring that uses two automatic pouring machines is one wherein the operations of two automatic pouring machines are controlled so that the operations of the first automatic pouring machine and the second automatic pouring machine are coordinated so as to have the molten metal be poured into each of a number of molds of a casting line for mold, which molds are sent out in a row from the molding machine, where a table of the data on molds is prepared that include the numbers of the patterns used for molding each of the molds, the information on the conditions for pouring each mold, and the number of the pouring machine that was used for pouring. Based on this table the method carries out the pouring the molten metal by coordinating the operations of the molding machine and the two automatic pouring machine.

Also, the method of pouring that uses the pouring equipment 50 is one wherein the operations of two automatic pouring machines are controlled so that the operations of the first automatic pouring machine and the second automatic pouring machine are coordinated so as to have the molten metal be poured into each of a number of molds of a casting line for mold, which molds are sent out in a row from the molding machine, the first automatic pouring machine comprising the first carriage that can run in the direction of the molds of the casting line for mold, which molds are lined up in a row and the first pouring ladle that is attached to and transported by the first carriage and the second automatic pouring machine comprising the second carriage that can run in the direction of the molds of the casting line for mold, which molds are lined up in a row and the second pouring ladle that is attached to and transported by the second carriage, and wherein the method comprises the equipment used for the method, the equipment comprising:

the main control device 12*a* that controls all the components, devices, etc., of the equipment and that comprises the device for storing the data on mold 18 that stores the data on molds with the corresponding numbers of the molds, while the data on molds include at least the information on the patterns that were used for molding each mold, the information on each mold as to whether the first pouring ladle 8 is scheduled to pour the molten metal in the mold, and also as to whether the second pouring ladle 9 has completed the pouring;

the first automatic pouring machine 51, which has the first pouring ladle 8 pour the molten metal, based on the control device for controlling the first pouring machine 13*a* that comprises the device for receiving the data on mold 25, the device for receiving information on the weight 28, the device for indicating the number of the pouring machine 30, the device for determining the mold into which the molten metal is poured 32, and the device for directing the operation of pouring 36; and the second automatic pouring machine 52, which has the second pouring ladle 9 pour the molten metal based on the control device for controlling the second pouring machine 14*a* that comprises the device for receiving the data on mold 39, the device for determining the mold into which the molten metal is poured 46, and the device for directing the operation of pouring 44;

wherein the method controls the operations of the two automatic pouring machines and realizes the smooth coordinated operation of the two automatic pouring machines such that the automatic pouring machines can pour the molten metal into each of a number of molds of a casting line for mold, which molds are sent out in a row from the high speed molding machine.

Also, the system for controlling pouring machines 53 and the equipment for pouring the molten metal 50 comprise:

the main control device 12*a* that comprises the device for storing the data on mold 18 that stores the data on each mold with the corresponding number of the mold; and the control device for controlling the first pouring machine 13*a* that comprises the device for receiving the data on mold 25, the device for receiving information on the weight 28, the device for indicating the number of the pouring machine 30, the device for determining the mold into which the molten metal is poured 32, and the device for directing the operation of pouring 36; and the control device for controlling the second pouring machine 14*a* that comprises the device for receiving the data on mold 39, the device for determining the mold into which the molten metal is poured 46, and the device for directing the operation of pouring 44, wherein the operations of the two automatic pouring machines are controlled and the smooth coordinated operation of the two automatic pouring machines is realized so that the automatic pouring machines can pour the molten metal into each of a number of molds of a casting line for mold, which molds are sent out in a row from the high speed molding machine.

Also, the system for controlling pouring machines 53 and the equipment for pouring the molten metal 50 of the present invention have the first automatic pouring machine 51 installed at the position which is downstream of the second automatic pouring machine 52. That is, the first automatic pouring machine 51 is installed nearer to the leading mold in the running direction of the molds than the second automatic pouring machine 52 is. The system for controlling pouring machines 53 and the equipment for pouring the molten metal 50 of the present invention having this characteristic in the layout combined with the formation of the devices, etc., as stated above, can prevent the two pouring ladles, i.e., the first pouring ladle 8 and the second pouring ladle 9, from mutually interfering, even if their movements are limited to smaller area. Thus the size of the equipment for pouring the molten metal 50 and the casting line for mold can be minimized.

As explained above, the system for controlling pouring machines 53, the equipment for pouring the molten metal 50, and the method of pouring of the present invention are controlled, based on the table of data on molds, which table of data is prepared so that it includes the numbers of the patterns used for molding molds, the information on the conditions for pouring each mold, and the number of the pouring machine that was used for pouring, such that the pouring of the molten metal can be carried out by the coordinated operation of the molding machine and the two automatic pouring machines.

Thus the system for controlling pouring machines 53, the equipment for pouring the molten metal 50, and the method of pouring of the present invention can produce effects where, by appropriately coordinating the operations of the molding machine and the two automatic pouring machines, the molten metal can be poured into each of a number of molds of a casting line for mold, which molds are sent out in a row from the molding machine.

The basic Japanese Patent Applications, No.2009-209565, filed Sep. 10, 2009, and No.2010-135386, filed Jun. 14, 2010 are hereby incorporated in its entirety by reference in the present application.

The present invention will become more fully understood from the detailed description of this specification. However, the detailed description and the specific embodiment illustrate desired embodiments of the present invention and are described only for the purpose of explanation. Various changes and modifications will be apparent to those of ordinary skills in the art on the basis of the detailed description.

The applicant has no intention to dedicate to the public any disclosed embodiments. Among the disclosed changes and modifications, those that may not literally fall within the scope of the present claims constitute, therefore, a part of the present invention in the sense of the doctrine of equivalents.

The use of the articles "a," "an," and "the," and similar referents in the specification and claims, are to be construed to cover both the singular and the plural, unless otherwise indicated herein or clearly contradicted by the context. The use of any and all examples, or exemplary language (e.g., "such as") provided herein, is intended merely to better illuminate the invention and does not pose a limitation on the scope of the invention unless otherwise claimed.

SYMBOLS

8 first pouring ladle
9 second pouring ladle
25 device for receiving the data on mold
28 device for receiving information on the weight
30 device for indicating the number of the pouring machine
32 device for determining the mold into which the molten metal is poured
36 device for directing the operation of pouring
39 device for receiving the data on mold
44 device for directing the operation of pouring
46 device for determining the mold into which the molten metal is poured
50 equipment for pouring molten metal
51 first automatic pouring machine
52 second automatic pouring machine
53 system for controlling pouring machines

The invention claimed is:

1. A system for controlling pouring machines that controls the operations of two automatic pouring machines so that the operations of a first automatic pouring machine and a second automatic pouring machine are coordinated so as to have molten metal be poured into each of a number of molds of a casting line for mold, which molds are sent out in a row from a molding machine, the first automatic pouring machine comprising a first carriage that can run in the direction of the number of molds of a casting line for mold, which molds are lined up in a row, and a first pouring ladle that is attached to and transported by the first carriage and the second automatic pouring machine comprising a second carriage that can run in the direction of the molds of the casting line for mold, which molds are lined up in a row, and a second pouring ladle that is attached to and transported by the second carriage, the system or controlling pouring machines comprising:

a main control device attached to a ground control panel disposed on the ground;

a control device for controlling the first pouring machine disposed on a control panel mounted on the first carriage; and a control device for controlling the second pouring machine disposed on a control panel mounted on the second carriage;

wherein the main control device comprises a device for storing data on mold, which device stores the data on mold and the number of the mold for each mold, the data on mold that are stored in the device for storing the data on a mold comprising at least information for each mold on the pattern that was used for molding each mold and also comprising information for each mold as to whether the first pouring ladle is scheduled to pour the molten metal in a mold and whether the second pouring ladle completed pouring the molten metal into the mold;

wherein the control device for controlling the first pouring machine comprises:

a first device for receiving the data on mold, which device receives the data on mold from the device for storing the data on mold of the main control device;

a device for receiving information on the weight, which device receives information on the weight of the molten metal in the first pouring ladle from a detecting device that detects the weight of the molten metal in the first pouring ladle;

a device for indicating the number of the pouring machine, which device calculates the number of molds and identifies the molds into which the molten metal can be poured, where the molds are counted starting from the leading mold in the running direction of the molds into which the molten metal have not yet been poured and where the calculation is made based on the information on the weight of the molten metal in the first pouring ladle and on the pattern of each mold, which information is received from the first device for receiving the data on mold and the device for receiving information on the weight, and where the device for indicating the number of the pouring machine instructs the device for storing the data on mold of the main control device to enter the data on the molds that are identified as ones into which the first pouring ladle is scheduled to pour the molten metal;

a device for determining the molds into which the first pouring machine pours the molten metal, which device determines the mold into which the molten metal is to be poured based on the data on mold that were received by the first device for receiving the data on mold and based on the information on current positions of the mold;

a device for directing the operation of pouring by the first pouring ladle, which device gives instructions to cause the movement of the first carriage and the start of pouring by the first pouring ladle to enable the first pouring ladle to pour the molten metal into the molds that are identified by the device for determining the molds into which the first pouring machine pours the molten metal;

wherein the control device for controlling the second pouring machine comprises:

a second device for receiving the data on mold, which device receives the data on mold from the device for storing the data on mold of the main control device;

a device for determining the molds into which the second pouring machine pours the molten metal, which device determines the mold into which the molten metal is to be poured based on the data on mold that were received by the second device for receiving the data on mold and based on the information on the current positions of the molds;

a device for directing the operation of pouring by the second pouring ladle, which device gives instructions to cause the movement of the second carriage and the start of pouring by the second pouring ladle to enable the second pouring ladle to pour the molten metal into the molds that are identified by the device for determining the molds into which the second pouring machine pours the molten metal.

2. The system for controlling pouring machines of claim 1, wherein if the mold into which the first pouring ladle is scheduled to pour the molten metal, where the pouring by the first pouring ladle is instructed by the device for indicating the number of the pouring machine based on the data on molds of the device for storing the data on mold, is positioned before the first pouring ladle, the device for determining the molds into which the first pouring machine pours the molten metal determines to pour the molten metal by the first pouring ladle into the leading mold in the direction of the transport of the molds.

3. The system for controlling pouring machines of claim 1 or 2, wherein if the mold into which the first pouring ladle is not scheduled to pour the molten metal, where instructions that the pouring is not to be carried out by the first pouring ladle are given by the device for indicating the number of the pouring machine based on the data on molds of the device for storing the data on mold, is positioned before the second pouring ladle, the device for determining the molds into which the second pouring machine pours the molten metal determines to pour the molten metal by the second pouring ladle into the leading mold in the direction of the transport of the molds.

4. Equipment for pouring molten metal, comprising:

a first automatic pouring machine comprising a first carriage that can run in the direction of a number of molds of the casting line for mold, which molds are lined up in a row and sent from a molding machine, and a first pouring ladle that is attached to and transported by the first carriage and a second automatic pouring machine comprising a second carriage that can run in the direction of a number of molds of the casting line for mold, which molds are lined up in a row, and a second pouring ladle that is attached to and transported by the second carriage, the two automatic pouring machines pouring the molten metal into a number of molds that are sent out in a row from the molding machine and a system for controlling pouring machines that controls the operations of two automatic pouring machines so that the operations of the first automatic pouring machine and the second automatic pouring machine are coordinated, wherein the system for controlling pouring machines comprises:

a main control device attached to a ground control panel disposed on the ground;

a control device for controlling the first pouring machine disposed on a control panel mounted on the first carriage; and a control device for controlling the second pouring machine disposed on a control panel mounted on the second carriage;

wherein the main control device comprises a device for storing data on mold, which stores the data on mold and the number of the mold for each mold, the data on mold that are stored in the device for storing the data on a mold comprising at least information for each mold on the pattern that was used for molding each mold and also comprising information for each mold as to whether the first pouring ladle is scheduled to pour the molten metal into a mold and whether the second pouring ladle completed pouring the molten metal in the mold;

wherein the control device for controlling the first pouring machine comprises:

a first device for receiving the data on mold, which device receives the data on mold from the device for storing the data on mold of the main control device;

a device for receiving information on the weight, which device receives information on the weight of the molten metal in the first pouring ladle from a detecting device that detects the weight of the molten metal in the first pouring ladle;

a device for indicating the number of the pouring machine, which device calculates the number of molds and identifies the molds into which the molten metal can be poured, where the molds are counted starting from the leading mold in the running direction of the molds into which the molten metal have not yet been poured and where the calculation is made based on the information on the weight of the molten metal in the first pouring ladle and on the pattern of each mold, which information is received from the first device for receiving the data on mold and the device for receiving information on the weight, and where the device for indicating the number of the pouring machine instructs the device for storing the data on mold of the main control device to enter the data on the molds that are identified as ones into which the first pouring ladle is scheduled to pour the molten metal;

a device for determining the molds into which the first pouring machine pours the molten metal, which device determines the mold into which the molten metal is to be poured, based on the data on mold that were received by the first device for receiving the data on mold and based on the information on current positions of the mold;

a device for instructing the first pouring ladle to start pouring, which device gives instructions to cause the movement of the first carriage and the start of pouring by the first pouring ladle to enable the first pouring ladle to pour the molten metal into the molds that are identified by the device for determining the molds into which the first pouring machine pours the molten metal;

wherein the control device for controlling the second pouring machine comprises:

a second device for receiving the data on mold, which device receives the data on mold from the device for storing the data on mold of the main control device;

a device for determining the molds into which the second pouring machine pours the molten metal, which device determines the mold into which the molten metal is to be poured, based on the data on mold that were received by the second device for receiving the data on mold and based on the information on the current positions of the molds;

a device for instructing the second pouring ladle to start pouring, which device gives instructions to cause the movement of the second carriage and the start of pouring by the second pouring ladle to enable the second pouring ladle to pour the molten metal into the molds that are identified by the device for determining the molds into which the second pouring machine pours the molten metal.

5. The equipment for pouring the molten metal of claim 4, wherein if the mold into which the first pouring ladle is scheduled to pour the molten metal, where the pouring by the first pouring ladle is instructed by the device for indicating the number of the pouring machine based on the data on molds of the device for storing the data on mold, is positioned before the first pouring ladle, the device for determining the molds into which the first pouring machine pours the molten metal determines to pour the molten metal by the first pouring ladle into the leading mold in the direction of the transport of the molds.

6. The equipment for pouring molten metal of claim 4 or 5, wherein if the mold into which the first pouring ladle is not scheduled to pour the molten metal, where instructions that the pouring is not to be carried out by the first pouring ladle are given by the device for indicating the number of the pouring machine based on the data on molds of the device for storing the data on mold, is positioned before the second pouring ladle, the device for determining the molds into which the second pouring machine pours the molten metal determines to pour the molten metal by the second pouring ladle into the leading mold in the direction of the transport of the molds.

7. A method of pouring molten metal by a first automatic pouring machine and a second automatic pouring machine into molds, where the pouring of the molten metal is controlled by a main control device that controls equipment for pouring the molten metal so that the operations of the first automatic pouring machine and the second automatic pouring machine are coordinated so as to have the molten metal be poured into each of a number of molds of a casting line for mold, which molds are sent out in a row from a molding machine, the first automatic pouring machine comprising a first carriage that can run in the direction of the number of molds of the casting line for mold, which molds are lined in a row and a first pouring ladle that is attached to and transported by the first carriage and the second automatic pouring machine comprising a second carriage that can run in the direction of the molds of the casting line for mold, which molds are lined up in a row, and a second pouring ladle that is attached to and transported by the second carriage, wherein the method comprises pouring the molten metal by the first and second automatic pouring machines based on information from the main control device that controls the equipment and comprises a device for storing data on mold that stores the data on molds with the corresponding numbers of the molds, while the data on molds include at least information on the patterns that were used for molding each mold, information on each mold as to whether the first pouring ladle is scheduled to pour the molten metal in the mold, and also as to whether the second pouring ladle has completed the pouring, (A) the first pouring machine pours the molten metal by the first pouring ladle under the control of the control device for controlling the first pouring machine, the control device for controlling the first pouring machine comprising:

a first device for receiving the data on mold, which device receives the data on mold from the device for storing the data on mold of the main control device;

a device for receiving information on the weight, which device receives information on the weight of the molten metal in the first pouring ladle from a detecting device that detects the weight of the molten metal in the first pouring ladle;

a device for indicating the number of the pouring machine, which device calculates the number of molds and identifies the molds into which the molten metal can be poured, where the molds are counted starting from the leading mold in the running direction of the molds into which the molten metal have not yet been poured and where the calculation is made based on the information on the weight of the molten metal in the first pouring ladle and on the pattern of each mold, which information is received from the first device for receiving the data on mold and the device for receiving information on the weight, and where the device for indicating the number of the pouring machine instructs the device for storing the data on mold of the main control device to enter the data on the molds that are identified as ones, into which the first pouring ladle is scheduled to pour the molten metal;

a device for determining the molds into which the first pouring machine pours the molten metal, which device determines the mold into which the molten metal is to be poured, based on the data on mold that were received by the first device for receiving the data on mold and based on information on the current positions of the mold;

a device for instructing the first pouring ladle to start pouring, which device gives instructions to cause the movement of the first carriage and the start of pouring by the first pouring ladle to enable the first pouring ladle to pour the molten metal into the molds that are identified by the device for determining the molds into which the first pouring machine pours the molten metal; and (B) the second pouring machine pours the molten metal by the second pouring ladle under the control of the control device for controlling the second pouring machine, the control device for controlling the second pouring machine comprising:

a second device for receiving the data on mold, which device receives the data on mold from the device for storing the data on mold of the main control device;

a device for determining the molds into which the second pouring machine pours the molten metal, which device determines the mold which the molten metal is to be poured into based on the data on mold that were received by the second device for receiving the data on mold and based on the information on the current positions of the molds;

a device for instructing the second pouring ladle to start pouring, which device gives instructions to cause the movement of the second carriage and the start of pouring by the second pouring ladle to enable the second pouring ladle to pour the molten metal into the molds that are identified by the device for determining the molds into which the second pouring machine pours the molten metal.

* * * * *